US011798721B2

(12) United States Patent
Miller, Jr.

(10) Patent No.: US 11,798,721 B2
(45) Date of Patent: Oct. 24, 2023

(54) HIGH-$T_c$ SUPERCONDUCTING ELECTROMAGNET FOR PERSISTENT CURRENT OPERATION

(71) Applicant: University of Houston System, Houston, TX (US)

(72) Inventor: John H. Miller, Jr., Houston, TX (US)

(73) Assignee: University of Houston System, Houston, TX (US)

( * ) Notice: Subject to any disclaimer, the term of this patent is extended or adjusted under 35 U.S.C. 154(b) by 997 days.

(21) Appl. No.: 16/479,524

(22) PCT Filed: Jan. 22, 2018

(86) PCT No.: PCT/US2018/014690
§ 371 (c)(1),
(2) Date: Jul. 19, 2019

(87) PCT Pub. No.: WO2018/136872
PCT Pub. Date: Jul. 26, 2018

(65) Prior Publication Data

US 2019/0341179 A1 Nov. 7, 2019

(51) Int. Cl.
*H01B 12/00* (2006.01)
*H01F 6/06* (2006.01)
(Continued)

(52) U.S. Cl.
CPC ..... *H01F 6/06* (2013.01); *H01B 12/00* (2013.01); *H01F 7/06* (2013.01); *H01F 41/048* (2013.01)

(58) Field of Classification Search
CPC ..... H01B 12/00; H01F 41/048; H01F 6/06
See application file for complete search history.

(56) References Cited

U.S. PATENT DOCUMENTS 5,426,408 A * 6/1995 Jones ..... H01F 6/06 505/211
6,590,394 B2 7/2003 Wong et al.
(Continued)

OTHER PUBLICATIONS

International Search Report and Written Opinion received in PCT Application No. PCT/US2018/014690, dated May 11, 2018.
(Continued)

*Primary Examiner* — Paul A Wartalowicz
(74) *Attorney, Agent, or Firm* — Blank Rome LLP

(57) ABSTRACT

A superconducting electromagnet and method for manufacturing, using, monitoring, and controlling same are disclosed. Embodiments are directed to a superconducting electromagnet that includes a superconductor tape including: a first unslotted end; a second unslotted end; and a longitudinally slotted section provided between the first unslotted end and the second unslotted end. The longitudinally slotted section includes a first longitudinal part and a second longitudinal part. The first longitudinal part is provided in a wound manner thereby defining a first coil. The second longitudinal part is provided in a wound manner thereby defining a second coil. These and other embodiments achieve persistent current operation of the superconducting electromagnet without the need for solder joints within the magnet coil itself, which can result in improved stability and reduced power consumption.

8 Claims, 8 Drawing Sheets

(51) Int. Cl.
*H01F 7/06* (2006.01)
*H01F 41/04* (2006.01)

(56) References Cited

U.S. PATENT DOCUMENTS

| | | | | |
|---|---|---|---|---|
| 9,117,576 | B2 * | 8/2015 | Oomen | H01F 41/071 |
| 2008/0207458 | A1 | 8/2008 | Hong et al. | |
| 2014/0066312 | A1 | 3/2014 | Kasten | |
| 2015/0340139 | A1 | 11/2015 | Arndt | |

OTHER PUBLICATIONS

Rong, C., et al., "Investigation of the Relaxation of Persistent Current in Superconducting Closed Loops Made Out of YBCO Coated Conductors," IEEE Transactions on Applied Superconductivity, vol. 25, No. 3, Jun. 2015.

Qiu, D., et al., "Experiment Study on Magnetic Field Homogeneity of the Persistent Current Mode Helmholtz Coils Made of HTS-Coated Conductor," IEEE Transactions on Applied Superconductivity, vol. 27, Issue: 4; Feb. 3, 2017, [retrived on Mar. 14, 2018], Retrieved from the Internet: URL: http://ieeexplore.ieee.org/document/7815361/, DOI: 10.1109/TASC.2017.2652539.

* cited by examiner

900

HIGH-$T_c$ SUPERCONDUCTING ELECTROMAGNET FOR PERSISTENT CURRENT OPERATION

CROSS REFERENCE TO RELATED APPLICATION(S)

This application is a national phase of PCT/US18/14690, filed Jan. 22, 2018, which claims priority to U.S. provisional patent application No. 62/448,561, filed on Jan. 20, 2017, which is hereby incorporated herein by reference in its entirety.

GOVERNMENT SPONSORSHIP

None.

FIELD

The embodiments disclosed herein are in the field of superconducting electromagnets. More particularly, the embodiments disclosed herein relate to superconducting electromagnets and methods for manufacturing, using, monitoring, and controlling same, which, inter alia, achieve persistent current operation of the superconducting electromagnet without the need for solder joints within the magnet coil itself, which can result in improved stability and reduced power consumption.

BACKGROUND

Several materials systems are being developed to solve the looming problems with energy generation, transmission, conversion, storage, and use. Superconductors are quite likely a unique system that provides a solution across a broad spectrum of energy problems. Superconductors enable high efficiencies in generators, power transmission cables, motors, transformers and energy storage. Further, superconductors transcend applications beyond energy to medicine, particle physics, communications, transportation, etc.

Progress in the fabrication of high-Ta superconducting (HTS) wires and tapes has reached the stage where large-scale applications will soon become reality. When fully developed, HTS magnets will have at least two important advantages over their low-Tc superconducting (LTS) magnet counterparts: 1) potential for operation in a closed-cycle, cryogen-free system or using low-cost liquid nitrogen; and/or 2) if cooled to lower temperatures (e.g., 4.2 K or 30 K), potential for operation at much higher magnetic fields than LTS magnets, due to the extremely high upper critical fields of HTS materials. Potential applications of HTS magnets include, but are not limited to: nuclear magnetic resonance (NMR), magnetic resonance imaging (MRI), large-scale electric motors and generators, superconducting magnetic energy storage, MAGLEV trains, and high-field magnets for particle accelerators or compact fusion reactors.

The leading HTS wire/tape technologies are the rolled bismuth strontium calcium copper oxide (BSCCO) powder-in-tube method and the second generation (2G) HTS tape, or coated conductor. The latter relies on ion beam assisted deposition (IBAD) of an oriented buffer layer onto a flexible metal tape, or using rolling-assisted biaxially-textured substrates (RABiTS), to enable crystalline orientation of subsequently deposited layers over kilometer-long tapes. The need to avoid grain boundaries with misoriented crystallites, however, has prevented the development of zero-resistance joints between HTS wires or tapes. This has precluded making HTS magnets that can operate in a stable, persistent current mode.

The idea described in the present disclosure is based on the slotted HTS loop concept demonstrated by C. C. Rong, et al. in an article entitled "*Investigation of the Relaxation of Persistent Current in Superconducting Closed Loops Made Out of YBCO Coated Conductors*", IEEE Transactions on Applied Superconductivity, Vol 25, No. 3, 8200805, 6 pages (June 2015), as shown in FIG. 1. FIG. 1 is a diagram illustrating Rong, et al.'s prior art superconducting loop made out of a slotted yttrium barium copper oxide (YBCO) coated conductor. The diameter of the cylinder is approximately 40 mm. The total width of the initial tape is 12 mm and the width of the slot is 1 mm. The resultant width of each conductor is 5.5 mm. Note that the loop avoids the need for soldered joints. When cooled below the transition temperature it can thus carry a persistent current. However, having only a single loop, it is not especially useful for large-scale magnet applications.

As such, a key concept proposed in the present disclosure is a method to apply a slotted superconductor idea to a long HTS superconductor tape and manufacture it into a multi-turn superconducting electromagnet. One specific exemplary embodiment is discussed below, and is illustrated using ordinary slotted tape, a small cylinder, and two container caps.

Thus, it is desirable to provide a superconducting electromagnet and method of manufacturing same that are able to overcome the above disadvantages.

These and other advantages of the present invention will become more fully apparent from the detailed description of the invention herein below.

SUMMARY

Embodiments are directed to a superconducting electromagnet comprising: a superconductor tape comprising: a first unslotted end; a second unslotted end; and a longitudinally slotted section provided between the first unslotted end and the second unslotted end. The longitudinally slotted section comprises a first longitudinal part and a second longitudinal part. The first longitudinal part is provided in a wound manner thereby defining a first coil. The second longitudinal part is provided in a wound manner thereby defining a second coil.

In an embodiment, the first unslotted end, second unslotted end, and longitudinally slotted section each comprise: a substrate; a buffer layer overlying the substrate; and a superconductor film overlying the buffer layer. The superconductor film may comprise REBCO.

In an embodiment, the first coil is positioned adjacent to the second coil and oriented relative to the second coil such that respective magnetic poles of the first coil and the second coil are aligned and oriented along the same respective direction.

In an embodiment, the first coil and the second coil are in a Helmholtz coil configuration. The superconducting electromagnet may be capable of magnetic field noise reduction.

In an embodiment, the first coil is positioned adjacent to the second coil and oriented relative to the second coil such that respective magnetic poles of the first coil and the second coil are oriented along opposite directions, whereby the respective magnetic poles of the first coil and the second coil oppose and face each other.

In an embodiment, the superconductor tape is over 10 meters in length.

Embodiments are also directed to a method of manufacturing a superconducting electromagnet. The method comprises: providing a superconductor tape comprising: a first unslotted end; a second unslotted end; and a longitudinally slotted section between the first unslotted end and the second unslotted end. The longitudinally slotted section comprises a first longitudinal part and a second longitudinal part. The method also comprises: winding the first longitudinal part onto a first reel to form a first coil; and winding the second longitudinal part onto a second reel to form a second coil. The first coil is coupled to the second coil via the first longitudinal part, the second longitudinal part, the first unslotted end, and the second unslotted end.

In an embodiment, the first unslotted end, second unslotted end, and longitudinally slotted section each comprise: a substrate; a buffer layer overlying the substrate; and a superconductor film overlying the buffer layer. The superconductor film may comprise REBCO.

In an embodiment, the first reel is fixedly connected to the second reel via a rod during the winding steps.

In an embodiment, the method further comprises: removing the first coil and the second coil from the rod; and positioning the first coil adjacent to the second coil and oriented relative to the second coil such that respective magnetic poles of the first coil and the second coil are aligned and oriented along the same respective direction.

In an embodiment, the method further comprises: removing the first coil and the second coil from the rod; and positioning and orienting the first coil and the second coil in a Helmholtz coil configuration. The superconducting electromagnet may be capable of magnetic field noise reduction.

In an embodiment, the method further comprises: removing the first coil and the second coil from the rod; and positioning the first coil adjacent to the second coil and oriented relative to the second coil such that respective magnetic poles of the first coil and the second coil are oriented along opposite directions, whereby the respective magnetic poles of the first coil and the second coil oppose and face each other.

In an embodiment, the superconductor tape is over 10 meters in length.

BRIEF DESCRIPTION OF THE DRAWINGS

The foregoing summary, as well as the following detailed description, will be better understood when read in conjunction with the appended drawings. For the purpose of illustration only, there is shown in the drawings certain embodiments. It's understood, however, that the inventive concepts disclosed herein are not limited to the precise arrangements and instrumentalities shown in the figures.

DETAILED DESCRIPTION

Figure 1:
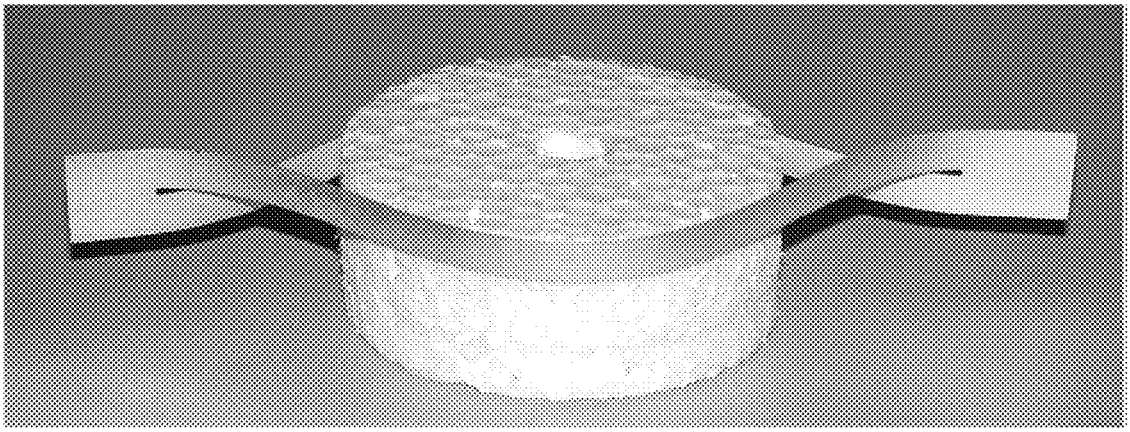
FIG. 1 (PRIOR ART)
FIG. 1 is a diagram illustrating a prior art superconducting loop made out of a slotted yttrium barium copper oxide (YBCO) coated conductor.

It is to be understood that the figures and descriptions of the present invention may have been simplified to illustrate elements that are relevant for a clear understanding of the present embodiments, while eliminating, for purposes of clarity, other elements found in a typical superconducting electromagnet or typical method for manufacturing, using, monitoring, or controlling a superconducting electromagnet. Those of ordinary skill in the art will recognize that other elements may be desirable and/or required in order to implement the present embodiments. However, because such elements are well known in the art, and because they do not facilitate a better understanding of the present embodiments, a discussion of such elements is not provided herein. It is also to be understood that the drawings included herewith only provide diagrammatic representations of the presently preferred structures of the present invention and that structures falling within the scope of the present embodiments may include structures different than those shown in the drawings. Reference will now be made to the drawings wherein like structures are provided with like reference designations.

Before explaining at least one embodiment in detail, it should be understood that the concepts set forth herein are not limited in their application to the construction details or component arrangements set forth in the following description or illustrated in the drawings. It should also be understood that the phraseology and terminology employed herein are merely for descriptive purposes and should not be considered limiting.

It should further be understood that any one of the described features may be used separately or in combination with other features. Other embodiments of devices, systems, methods, features, and advantages described herein will be or become apparent to one with skill in the art upon examining the drawings and the detailed description herein.

It's intended that all such additional devices, systems, methods, features, and advantages be protected by the accompanying claims.

For purposes of this disclosure, the terms "film" and "layer" may be used interchangeably.

Also, for purposes of this disclosure, the terms "reel", "spool", "sleeve", and "cap" may be used interchangeably.

Further, for purposes of this disclosure, the terms "rod" and "cylinder" may be used interchangeably.

Yet further, for purposes of this disclosure, the terms "slit" and "slot" may be used interchangeably.

Embodiments of the present application are directed to a method of creating a superconducting electromagnet using a partially slit (or slotted) high-Tc super-conducting (HTS) tape (e.g., coated conductor on a flexible metal substrate), which circumvents the need for resistive joints. The magnet could be operated in a persistent current mode, using any of several flux-pumping methods to ramp the current and magnetic field up to, and maintain, the operational mode, which would enable improved stability and reduced power consumption for various applications such as nuclear magnetic resonance (NMR), magnetic resonance imaging (MRI), large-scale electric motors and generators, superconducting magnetic energy storage, MAGLEV trains, and high-field magnets for particle accelerators and compact fusion reactors.

The idea builds on prior art by Rong, et al. (mentioned above) to partially slice a long HTS tape or coated conductor lengthwise, leaving the tape unsliced at the two ends to create a loop. One method of magnet assembly, proposed in this disclosure, is to use two demountable reels/spools/sleeve/caps connected by a rod/cylinder for rolling the two parts of a double-pancake or Helmholtz HTS coil. One intact (non-slotted) end of the HTS tape (e.g., 12-mm wide) is attached to the rod in the middle of the rod, while the separately sliced halves of the tape (e.g., 6-mm wide) are threaded into the two reels.

The rod used in the method of manufacturing the superconducting electromagnet may have any shape cross-section (e.g., circular) which is perpendicular to the longitudinal direction of the rod. The diameter of the rod at the cross-section will depend on the specific magnet application, and can range from <1 cm to several meters. The rod may be solid or hollow and may comprise any material having sufficient strength suitable to enable winding of the superconductor tape onto the reels to form the coils. The rod may be detachable from at least one of the reels at one or more suitable locations to enable subsequent separation and possible flipping of one reel by 180° to align the two magnetic fields in a parallel direction. Multiple rods may alternatively be employed connecting the two reels.

The reels used in the method of manufacturing the superconducting electromagnet may have any shape cross-section (e.g., circular) which is perpendicular to the longitudinal direction of the reels. The reels may comprise two constraining disks or sleeves, which may be solid, spoked, perforated, slotted, and/or segmented, adjoining a central hollow spool having a smaller outside diameter than the outside diameters of the two disks or sleeves. The central hollow spool is positioned between the two constraining disks or sleeves (e.g., resembling a movie film reel). The central hollow spool allows for the winding of the superconducting wire or tape thereon, between the disks/sleeves. The inner diameter of the central hollow spool will depend on the specific magnet application, and can range from <1 cm to several meters. The outer diameter of the disks or sleeves may be up to several times larger than the outer diameter of the central hollow spool and will preferably be large enough to accommodate the winding of the superconducting wire or tape. The reels may be machined from a single cylinder or may comprise detachable sleeves/disks and a central hollow spool therebetween. The reels may comprise any material having sufficient strength suitable to enable winding of the superconductor tape thereon to form the coils.

The rod is fixed relative to the reels so that rotating movement of the rod translates to movement of the reels, or similarly, rotating movement of either or both of the reels translates to movement of the rod. The rod and reels undergo the rotating movement to perform the winding of the superconductor tape to form the coils. This rotating movement may be employed by connecting a rotating mechanism to rod and/or either or both of the reels. For example, the rotating mechanism may be a rotary motor comprising a rotatable shaft coupled to an end of the rod, thereby enabling rotating movement of the rod which translates to rotating movement of the reels.

The slit may be provided as a longitudinal slice separating the two sections or halves (i.e., with no loss or removal of tape material). Alternatively, the slit may be provided as a result of a removal of a longitudinal portion of tape material between the two sections or halves (e.g., similar to Rong, et al.'s tape in FIG. 1). Assuming equal width halves, this latter option would have the two halves at a slightly smaller width (e.g., 5.5 mm) as compared to a slightly larger width (e.g., 6 mm) which would occur using the former "slicing" option. It is noted that the slot may or may not be provided at the longitudinal center of the tape. Alternatively, the two sections may not be equal in width (i.e., when the slot is not positioned centrally along the width of the tape) and thus the two sections would not be considered "halves".

Both sections or halves of the already-slotted tape are then rolled onto the reels simultaneously until the other intact (non-slotted) end is approached, but preferably leaving a significant amount of play in the remaining HTS loop. The resulting magnet would, in principle, enable persistent current operation with an opposing Helmholtz coil configuration, but this would not be ideal for most applications. Therefore, at this stage, taking advantage of the slack in the extra HTS tape in the middle, one of the two pancake coils would be flipped 180° and then either placed adjacent to the first pancake coil (thereby providing a "double-pancake" configuration) or kept some distance away for a normal Helmholtz coil configuration. During operation of the magnet, prior art on-flux pumping methods could be used to ramp-up the current and magnetic flux and maintain the magnet in a persistent current mode.

FIGS. 1-6 are diagrams illustratively depicting silver tape representing HTS tape which attaches to a cylinder/rod that couples two reels (e.g., end container caps) and attaches to the two reels. The reels are representative of the eventual two sections or halves of the superconducting electromagnet.

Figure 2:
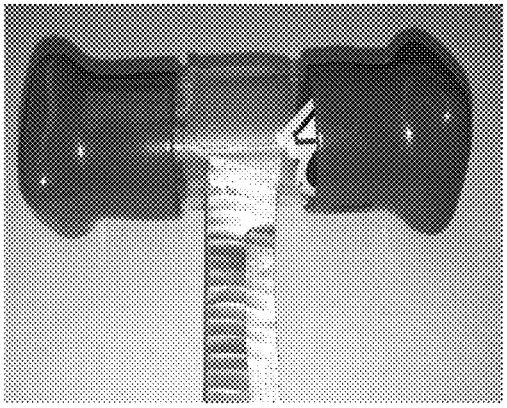
FIG. 2 is a diagram illustratively depicting silver tape representing HTS tape which is attached to a cylinder that couples two reels (i.e., end container caps).
Figure 3:
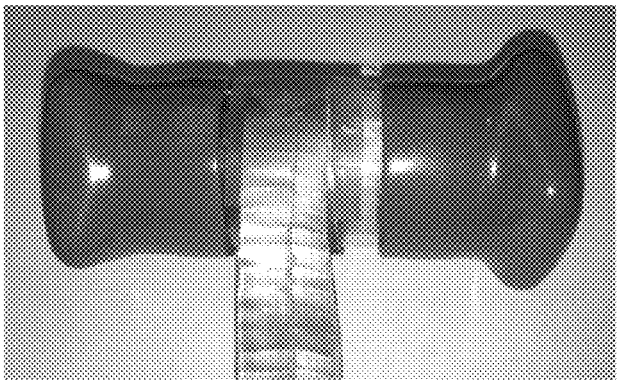
FIG. 3 is a diagram illustratively depicting several turns of the silver tape (representing the HTS tape) shown in FIG. 2 being wound onto the central portion of the cylinder. While, the radius of the turns in FIG. 3 is approximately 1 cm, an HTS tape wound in this manner would have a radius which can range from <1 cm (e.g., small bore magnet) to several meters (e.g., MRI or fusion reactor magnet).

More specifically, an embodiment of a method of manufacturing an electromagnet includes providing a slotted HTS tape (e.g., RE-Ba—Cu—O (REBCO, RE=rare earth) coated conductor), the first step is to attach a first unslotted end to a cylinder/rod that couples two reels used for winding, as illustrated in FIG. 2 which, by way of example only, is a diagram illustratively depicting silver tape representing HTS tape. The silver tape (representing the HTS tape) is attached to the cylinder that couples two reels defined by end container caps. The attachment location of the tape is between the two reels which are provided at opposite ends of the cylinder. Next, part of the tape is rolled onto the central cylinder portion, as shown in FIG. 3. FIG. 3, by way of example only, is a diagram illustratively depicting several turns of the silver tape (representing the HTS tape) shown in FIG. 2 being wound onto the central portion of the cylinder. While the radius of the turns in FIG. 3 is approximately 1 cm, an HTS tape wound in this manner could have a radius which can range from <1 cm (e.g., small bore magnet) to several meters (e.g., MRI or fusion reactor magnet).

Figure 4:
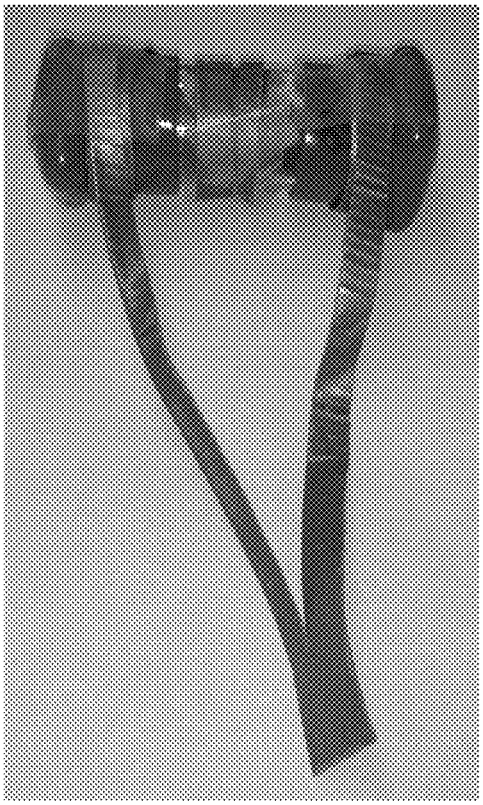
FIG. 4 is a diagram illustratively depicting the opposite end of the tape, after winding the two halves of the electromagnet on the opposing end caps.

The winding is continued, but this time the two halves or sections of the tape are wound around the reels that will become the two halves or sections of the electro-magnet, as shown in FIG. 4, which shows only a few turns for each side. More realistically, for this step, the number of turns could be in the hundreds or even thousands. FIG. 4, by way of example only, is a diagram illustratively depicting the opposite end of the tape, after winding the two halves or sections of the electromagnet on the opposing end caps.

Figure 5:
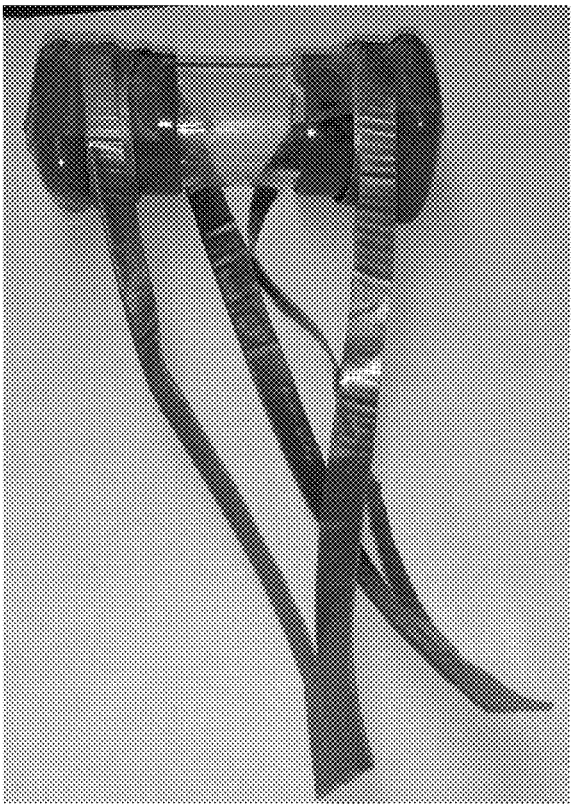
FIG. 5 is a diagram illustratively depicting an optional configuration or step where the centrally wound portion of the tape can be unwound from the central portion of the cylinder in order to subsequently enable flipping one reel around, e.g., 180°.

FIG. 5, by way of example only, is a diagram illustratively depicting an optional configuration or step where the centrally wound portion of the tape can be unwound from the central portion of the cylinder in order to subsequently enable flipping one reel around, e.g., 180°. More specifically, as an optional step (FIG. 5), the portion wound onto the center cylinder could now be unwound to create enough free play in the tape to flip one reel around, if necessary. If an electric current were to flow in the tape in FIG. 5, one reel (viewed end on) would have a clockwise current, while the current in the other reel would be counterclockwise, creating magnets with opposing poles facing each other. This "opposing" Helmholtz configuration might be suitable for limited applications, e.g., part of the "polywell" concept proposed to contain plasmas for fusion reactors.

Figure 6:
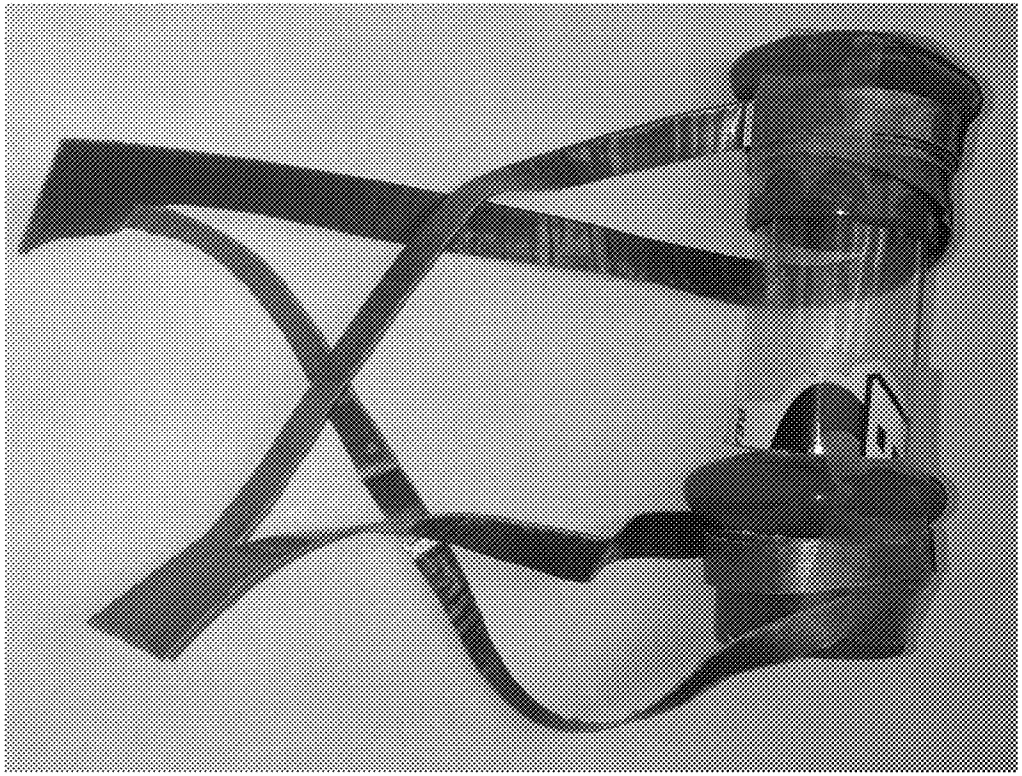
FIG. 6 is a diagram illustratively depicting the right hand reel after having been flipped 180° to create a Helmholtz coil orientation, where the magnet poles are aligned, consistent with the optional configuration or step shown in FIG. 5.
Figure 7:
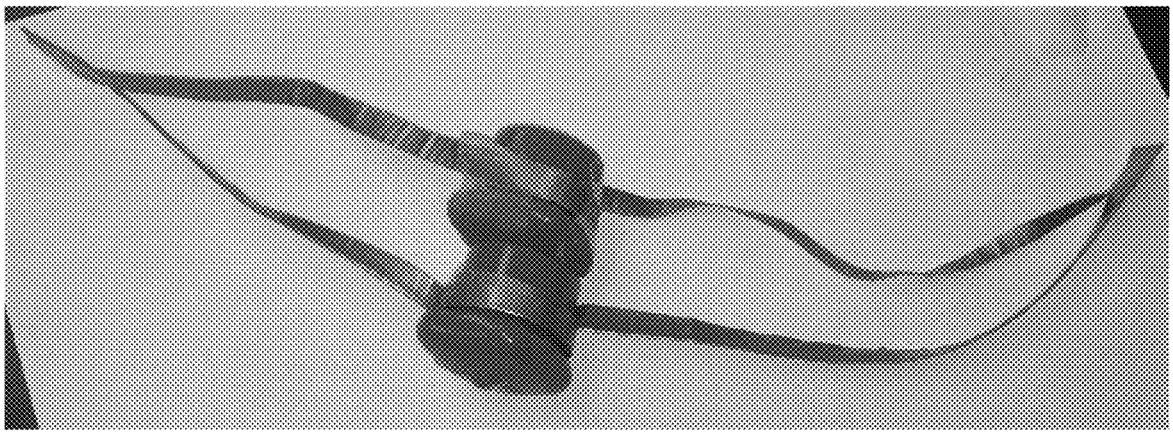
FIG. 7 is a diagram illustratively depicting the removal of the center cylinder to enable a double pancake coil positioned with the two reels adjacent to each other. Note the open loops of the tape are now visible, which enable flux pumping. More realistically, the two pancake coil reels would be narrower along the magnetic field axis (but with a larger radius) and have many more turns of HTS tape, thus more closely resembling two stacked pancakes.

For the vast majority of applications, however, the two halves of the magnet would be provided with their poles oriented along the same direction. For such applications, therefore, one of the two reels would need to be flipped 180°, as shown in FIG. 6 and FIG. 7. In other words, FIG. 6, by way of example only, is a diagram illustratively depicting the right-hand reel after having been flipped 180° which creates a Helmholtz coil orientation, where the magnet poles are aligned, subsequent the step shown in FIG. 5. FIG. 6 depicts (roughly) a Helmholtz coil configuration, i.e., with the center cylinder still in place. And FIG. 7 depicts a Helmholtz coil configuration, i.e., after removal of the center cylinder.

FIG. 7 represents a double-pancake, in which the center cylinder has been removed and the two coils are adjacent to each other. FIG. 7, by way of example only, is a diagram illustratively depicting the removal of the center cylinder to enable a double pancake coil positioned with the two reels adjacent to each other. Note the open loops of the tape are now visible, which enable flux pumping. In an embodiment, the two pancake coil reels would be narrower along the magnetic field axis (but with a larger radius) and have many more turns of HTS tape, thus more closely resembling two stacked pancakes. Such a double pancake would generally be used as one module of a much larger magnet, e.g., a long solenoid with many stacked double-pancakes or a Helmholtz coil magnet consisting of two or more double pancakes on each side.

An important issue concerns how to generate persistent current flow in the closed HTS loop. This problem has largely been solved for LTS magnets where a variety of flux pumping methods are employed.

More recently, new flux pumping methods have been proposed, suitable for HTS magnets. For example, we would need to attach to the lead in FIG. 7 (using, for example, two low-resistance solder joints) an extra HTS loop coupled to the low-frequency AC current output of a transformer. An AC magnetic field (suitably timed to the transformer output) would also be applied to a portion of the open lead in FIG. 7, causing that region to incrementally show finite resistance and act as an intermittent rectifier switch. If timed such that the transformer output current feeds into the HTS magnet at appropriate intervals, this would cause current to be incrementally added to the magnet until it ramps up to its desired maximum value. In the setup proposed here, persistent current operation would be maintained in the joint-less main loop for much longer than in previous HTS magnets, which require joints and thus have finite resistance even in the main magnets, and hence show more rapid decay of the magnetic field. It is therefore expected that the embodiments of the invention disclosed herein will lead to more stable operation and lower power consumption than previous HTS magnets, while maintaining the advantages of HTS over LTS materials.

Figure 8:
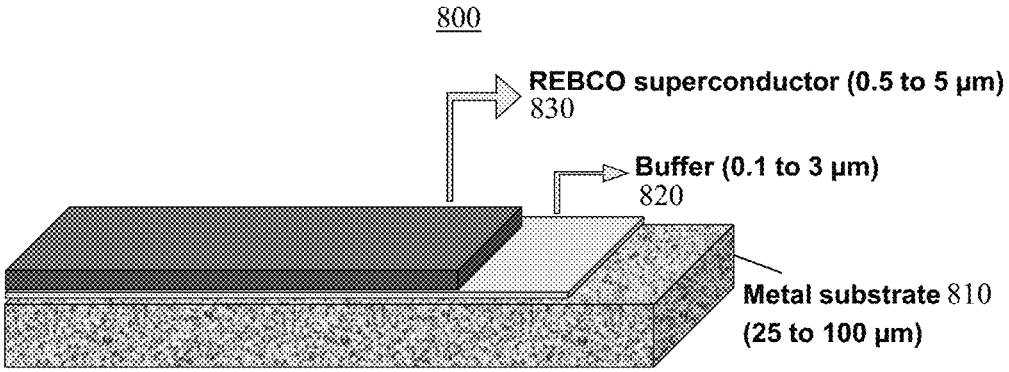
FIG. 8 is a perspective schematic and cross-sectional diagram illustrating a microstructure of an ultra-thin film HTS tape used to manufacture an HTS electromagnet, in accordance with an embodiment.

FIG. 8, by way of example only, is a perspective schematic and cross-sectional diagram illustrating a microstructure of an ultra-thin film HTS tape 800 used to manufacture an HTS electromagnet, in accordance with an embodiment. The superconductor tape 800 comprises: a substrate 810; a buffer layer 820 overlying the substrate 810; and a superconductor film 830 overlying the buffer layer 820. In one embodiment, the superconductor tape is over 10 meters in length, but could have a length ranging from less than one meter to several kilometers. In another embodiment, the superconductor film comprises REBCO but other superconductor films may alternatively be employed. The thickness of the superconductor film may be at least 0.5 μm. The buffer layer may comprise only a single buffer layer or may comprise multiple buffer layers. The thickness of the buffer layer (i.e., whether comprising only a single buffer layer or multiple buffer layers) may, for example, be within the range of 0.1 to 3 μm. The substrate may comprise, for example, a material selected from the group consisting of metals such as Hastelloy, Stainless Steel, Ni—W, Inconel, metallic glasses, and combinations thereof, and may have a thickness within the range of 25 to 100 μm, but may be fabricated in a smaller or larger thickness in other embodiments. Alternative embodiments may include HTS tapes initially fabricated using, for example, a powder-in-tube method, whereby BSCCO is packed into silver tubes, which are repeatedly pressed, drawn, and heat-treated into long tapes which are then slit or otherwise provided with slots as described in this disclosure. Any of the processes described in this disclosure may be suitable for any other embodiment in which a superconducting loop, including one consisting of a round wire, flat tape, or multi-filamentary wire or cable, is fabricated either before or during the magnet winding. For example, a superconducting loop could be created whereby the ends of single- or multi-filamentary 'powder-in-tube' wire are initially joined together prior to their subsequent drawing, heat treatment, and other processes, to create a long loop of flat, round, or multi-filamentary HTS wire which would then be wound as described herein. This particular process may effectively still be considered as being topologically equivalent to the slotted and unslotted sections of tape which is wound as described herein. Alternatively, deposition of the needed layers (e.g., buffer and HTS layers) on a split substrate for a second generation high temperature superconducting (e.g., REBCO) tape could take place concurrently with the winding process described herein.

The superconducting electromagnet may comprise a slotted tape comprising the exemplary tape shown in FIG. 8

(i.e., with no protective layers). Alternatively, any number of protective layers may additionally be employed. For example, the superconducting electromagnet may comprise a slotted tape comprising the exemplary tape shown in FIG. 9 (i.e., with silver and copper protective layers).

Figure 9:
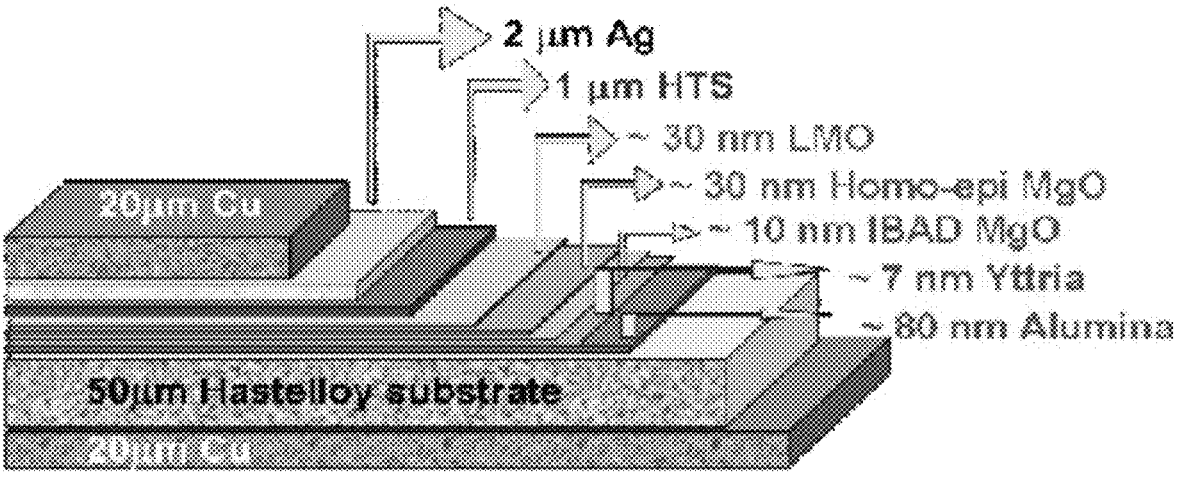
FIG. 9 is a perspective schematic and cross-sectional diagram illustrating a microstructure of an ultra-thin film HTS tape, with protective layers, used to manufacture an HTS electromagnet, in accordance with an embodiment.

FIG. 9, by way of example only, is a perspective schematic and cross-sectional diagram illustrating a microstructure of an ultra-thin film HTS tape 900, with silver and copper protective layers, used to manufacture an HTS electromagnet, in accordance with an embodiment. The superconductor tape 900 comprises a substrate comprising a 50 μm thick Hastelloy layer. The superconductor tape also comprises a buffer layer overlying the substrate. The buffer layer comprises multilayers which comprise an ~80 nm thick Alumina layer, a ~7 nm thick Yttria layer, a ~10 nm thick IBAD MgO layer, a ~30 nm thick Homo-epi MgO layer, and a ~30 nm thick LMO layer. The superconductor tape also comprises a superconductor layer overlying the (multilayered) buffer layer. The superconductor layer comprises a 1 μm thick HTS layer. A 2 μm thick silver layer overlies the superconductor layer, and a 20 μm thick copper layer overlies the silver layer. A 20 μm thick copper layer is also provided beneath the substrate and/or surrounds the remaining layers of the tape.

Alternatively, the HTS electromagnet may comprise a slotted tape comprising other HTS-type tapes made, for example, via RABiTS or via powder-in-tube fabrication methods.

Figure 10:
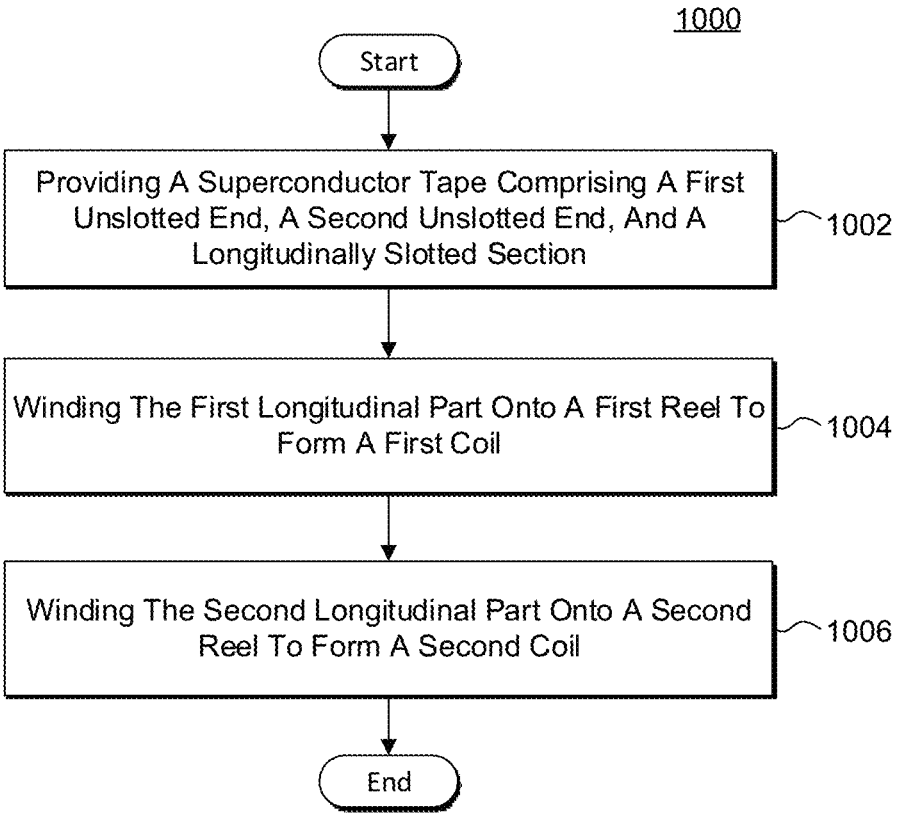
FIG. 10 is a flowchart illustrating an embodiment of a method of manufacturing an HTS electromagnet, in accordance with an embodiment.

By way of example only, FIG. 10 is a flowchart of a method 1000 of manufacturing a superconducting electromagnet. In an embodiment, the method 1000 comprises providing a superconductor tape comprising a first unslotted end, a second unslotted end, and a longitudinally slotted section (block 1002) between the first unslotted end and the second unslotted end. The longitudinally slotted section comprises a first longitudinal part and a second longitudinal part. The method also comprises winding the first longitudinal part onto a first reel to form a first coil (block 1004). The method further comprises winding the second longitudinal part onto a second reel to form a second coil (block 1006). The first coil is coupled to the second coil via the first longitudinal part, the second longitudinal part, the first unslotted end, and the second unslotted end.

The inability to create fully superconducting joints in HTS wires and coated conductors has prevented operation of HTS electromagnets in stable persistent current mode. Embodiments described above circumvent the need to create such joints within the magnet coil itself. Embodiments would therefore allow, previously unattainable, persistent current operation of an HTS electromagnet, thus improving stability and reducing power consumption for nuclear magnetic resonance (NMR), magnetic resonance imaging (MRI), large-scale electric motors and generators, superconducting magnetic energy storage, MAGLEV trains, high-field magnets for particle accelerators or compact fusion reactors, and other applications.

The winding scheme, or slight variations thereof, could be applied to magnetic field noise cancelling. Here, induced screening currents in the two superconducting coils could reduce external magnetic field noise in a region near the middle of a Helmholtz-coil configuration. Applications would include magnetic noise reduction for MRI, biomagnetism, and other applications. A property of superconducting loops and coils is that they tend to maintain a constant magnetic flux inside, even if that flux is initially zero. Any temporal change in external magnetic field will automatically induce screening currents in a superconducting loop, coil, or Helmholtz coil. The opposing field created by those screening currents cancels the flux from the external time-varying field (magnetic field noise), thereby greatly reducing the magnetic flux noise inside the loop, coil, or Helmholtz coil. For some applications, three superconducting Helmholtz coils would be arranged with their axes oriented along three perpendicular directions to attain cancellation of all three components of magnetic field noise. Unlike with normal metal coils, no active noise cancellation is required.

The winding scheme, or slight variations thereof, could also be applied to wire-wound superconducting flux transformers and/or gradiometers for magnetic sensing applications, including biomagnetism, non-destructive testing, etc. These have already been developed using low-Tc superconducting wire, where the gradiometer and/or flux transformer couples to a magnetic sensor, such as a superconducting quantum interference device (SQUID). Any of the winding schemes disclosed herein may be used to make a similar gradiometer and/or flux transformer using high-Tc superconducting wire or tape.

Although embodiments are described above with reference to winding of a superconductor tape which comprises a slotted section between unslotted ends, the winding described in any of the above embodiments may alternatively utilize an unslotted superconductor tape (which may be in the form of, for example, a round wire). In this alternative scenario, tape ends may be initially joined together prior to their subsequent drawing, heat treatment, and other processes, to create a long loop of flat, round, or multi-filamentary HTS wire which would then be wound as described herein. This particular process may effectively still be considered as being topologically equivalent to the slotted and unslotted sections of tape which is wound as described herein. Such alternative is considered to be within the spirit and scope of the present invention, and may therefore utilize the advantages of the configurations and embodiments described above.

It is understood that the superconducting electromagnetic and/or superconducting film discussed in connection with FIG. 8 and FIG. 9 can include one or more of the features discussed above in connection with those figures. Features in any of the embodiments described above may be employed in combination with features in other embodiments described above, and such combinations are considered to be within the spirit and scope of the present invention. Moreover, although the embodiments in method 1000 and the structure of the superconductor tapes are described above with reference to various layers, additional and/or different layers may alternatively be implemented in the method 1000 as well as the structure of the superconductor tapes in the electromagnets described in any of the embodiments above. Furthermore, the method steps in any of the embodiments described herein are not restricted to being performed in any particular order. Such additions and/or alternatives are considered to be within the spirit and scope of the present invention, and may therefore utilize the advantages of the configurations and embodiments described above. The contemplated modifications and variations specifically mentioned above are considered to be within the spirit and scope of the present invention.

It's understood that the above description is intended to be illustrative, and not restrictive. The material has been presented to enable any person skilled in the art to make and use the concepts described herein, and is provided in the context of particular embodiments, variations of which will be readily apparent to those skilled in the art (e.g., some of the disclosed embodiments may be used in combination with each other). Many other embodiments will be apparent to those of skill in the art upon reviewing the above description. The scope of the embodiments herein therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method of manufacturing a superconducting electromagnet, the method comprising:

providing a superconductor tape comprising:

a first unslotted end;

a second unslotted end; and a longitudinally slotted section between the first unslotted end and the second unslotted end, the longitudinally slotted section comprising:

a first longitudinal part; and a second longitudinal part;

winding the superconducting tape onto a central portion of a rod;

winding the first longitudinal part onto a first reel to form a first coil;

winding the second longitudinal part onto a second reel to form a second coil; and unwinding the superconducting tape on the central portion of the rod after winding the first longitudinal part and the second longitudinal part, wherein the first reel is fixedly connected to the second reel via the rod during the winding steps; and wherein the first coil is coupled to the second coil via the first longitudinal part, the second longitudinal part, the first unslotted end, and the second unslotted end.

2. The method of claim 1, wherein the first unslotted end, second unslotted end, and longitudinally slotted section each comprise:

a substrate;

a buffer layer overlying the substrate; and a superconductor film overlying the buffer layer.

3. The method of claim 2, wherein the superconductor film comprises REBCO.

4. The method of claim 1, further comprising:

removing the first coil and the second coil from the rod; and positioning and orienting the first coil and the second coil in a Helmholtz coil configuration.

5. The method of claim 4, wherein the superconducting electromagnet is capable of magnetic field noise reduction.

6. The method of claim 1, further comprising:

removing the first coil and the second coil from the rod; and positioning the first coil adjacent to the second coil and oriented relative to the second coil such that respective magnetic poles of the first coil and the second coil are aligned and oriented along the same respective direction.

7. The method of claim 1, further comprising:

removing the first coil and the second coil from the rod; and positioning the first coil adjacent to the second coil and oriented relative to the second coil such that respective magnetic poles of the first coil and the second coil are oriented along opposite directions, whereby the respective magnetic poles of the first coil and the second coil oppose and face each other.

8. The method of claim 1, wherein the superconductor tape is over 10 meters in length.

* * * * *